US007070835B2

(12) United States Patent
Burns

(10) Patent No.: US 7,070,835 B2
(45) Date of Patent: Jul. 4, 2006

(54) METHOD FOR APPLYING A COATING TO A SUBSTRATE

(75) Inventor: Andrew Jeremiah Burns, Orlando, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 109 days.

(21) Appl. No.: 10/457,503

(22) Filed: Jun. 9, 2003

(65) Prior Publication Data

US 2004/0247793 A1 Dec. 9, 2004

(51) Int. Cl.
*B05D 1/02* (2006.01)
*B05D 1/08* (2006.01)

(52) U.S. Cl. ..... 427/446; 427/569; 427/421.1

(58) Field of Classification Search ..... 427/479, 427/446–456, 421–427, 569, 421.1
See application file for complete search history.

(56) References Cited

U.S. PATENT DOCUMENTS

| | | | | |
|---|---|---|---|---|
| 5,126,529 | A | | 6/1992 | Weiss et al. |
| 5,158,849 | A | | 10/1992 | Katsen |
| 5,210,114 | A | | 5/1993 | Katsen |
| 5,362,523 | A | * | 11/1994 | Gorynin et al. ..... 427/446 |
| 5,817,372 | A | | 10/1998 | Zheng |
| 6,180,258 | B1 | | 1/2001 | Klier |
| 6,242,050 | B1 | | 6/2001 | Ritter et al. |
| 6,368,727 | B1 | | 4/2002 | Ritter et al. |
| 6,503,575 | B1 | | 1/2003 | Payne et al. |

FOREIGN PATENT DOCUMENTS

EP 0542542 * 12/1992

* cited by examiner

*Primary Examiner*—Fred J. Parker

(57) ABSTRACT

A exemplary method of depositing a coating on a substrate using a spray process is provided that may include selecting a desired dominant feature (62) for the coating and controlling the spray process (64, 68) to have at least one of an in-flight particle temperature distribution and an in-flight particle velocity distribution predicted to produce the dominant feature. One aspect allows for adjusting (64, 68) the at least one distribution to cause the distribution to shift from an in-flight Gaussian particle distribution to an in-flight non-Gaussian particle distribution. It may be determined whether the dominant feature for the coating is deposited within acceptable limits (66) and adjusting the at least one in-flight particle distribution (68) if the dominant feature for the coating is not deposited within acceptable limits. One aspect allows for depositing on the substrate a spray jet of particles having a bimodal distribution of particle temperature and a bimodal distribution of particle velocity. These bimodal distributions may be tailored or adjusted (64, 68) to achieve a desired dominant feature of the coating. A plurality of particle distributions may be evaluated (60) to determine at least one respective dominant feature that is a characteristic of a coating applied using the respective evaluated particle distribution. At least one dominant feature to be a characteristic of the coating may be determined (62) and at least one of the evaluated particle distributions predicted to produce the at least one dominant feature may be selected (63) to form the non-Gaussian distribution.

16 Claims, 5 Drawing Sheets

+

||

METHOD FOR APPLYING A COATING TO A SUBSTRATE

FIELD OF THE INVENTION

This invention relates in general to methods for applying coatings to substrates and in particular to a method for applying a coating using a spray jet of particles.

BACKGROUND OF THE INVENTION

Effective particle deposition processes, such as thermal spray processes, are limited by a range of spray process variables that are necessary to produce coatings having limited ranges of acceptable microstructures and morphologies. The operating parameters of a thermal spray process include these spray process variables as well as fixed process parameters. Spray process operating parameters result in a window of coating microstructure and morphology that is a direct result of complex interactions of process and material property variables during the spray process. These complex interactions combine to form two measurable in-flight particle characteristics or properties that contribute to coating microstructure and morphology. These are the temperature and velocity distributions of in-flight particles. Standard or classic thermal spray applications typically produce Gaussian or normal in-flight particle temperature and velocity distributions that may be measured using known instruments, such as the DPV 2000 manufactured by TECNAR. The result of using Gaussian distributions is typically a single output of average particle temperature and velocity with a defined deviation for a given set of spray process operating parameters and/or coating specifications. This results in only a small window of coating microstructure and morphology for that specific spray process.

Changing the average value of the Gaussian distributions for in-flight particle temperature and velocity makes it possible to change the average characteristics of the coating being deposited. The average characteristics are those microstructurally and morphologically important properties of a coating that affect its performance. In general, as the temperature and velocity of in-flight particles are increased, the particles become more molten and impact at a higher rate forming a denser coating. As the temperature and velocity are increased even further, splashing begins to occur as well as foreign matter entrapment. As the temperature and velocity are lowered, porosity becomes higher and the presence of un-melted particles increases causing a weaker coating to form. Changing the standard deviation without changing the average values of the temperature and velocity distributions inherently affects the non-uniformity of the deposited coating. This is because there is a broader range of temperature and velocity over which the particles are spread during deposition. In general, the standard or classic approach in a thermal spray process has been to reduce the standard deviations around a central or narrow range of temperature and velocity average distribution values that is known to deposit an acceptable coating.

U.S. Pat. No. 5,817,372 discloses a method of depositing a bond coat of a thermal barrier coating system by choosing two particle powders having different sizes. The particle size distributions of the two powders are chosen to yield a bond coat characterized by a particular macro-surface roughness attributable to particles of a coarser powder.

SUMMARY OF THE INVENTION

A exemplary method of depositing a coating on a substrate using a spray process is provided that may include selecting a desired dominant feature for the coating and controlling the spray process to have at least one of an in-flight particle temperature distribution and an in-flight particle velocity distribution predicted to produce the dominant feature. One aspect allows for adjusting the at least one distribution to cause the distribution to shift from an in-flight Gaussian particle distribution to an in-flight non-Gaussian particle distribution. It may be determined whether the dominant feature for the coating is deposited within acceptable limits and adjusting the at least one in-flight particle distribution if the dominant feature for the coating is not deposited within acceptable limits. One aspect allows for depositing on the substrate a spray jet of particles having a bimodal distribution of particle temperature and a bimodal distribution of particle velocity.

Another aspect allows for directing a spray jet of particles having a non-Gaussian distribution of at least one of particle temperature and particle velocity toward the surface. A first and a second particle temperature distribution may be selected that are predicted to produce a dominant feature of the coating when applied to the surface and a first and a second particle velocity distribution may be selected that are predicted to produce a dominant feature of the coating when applied to the surface. The spray jet of particles may be produced so that the selected distributions are combined to form a bimodal distribution of particle temperature and a bimodal distribution of particle velocity. Another aspect allows for evaluating a plurality of particle distributions to determine at least one respective dominant feature that is a characteristic of a coating applied using the respective evaluated particle distribution. At least one dominant feature to be a characteristic of the coating may then be determined and at least one of the evaluated particle distributions predicted to produce the at least one dominant feature may be selected to form the non-Gaussian distribution.

Another aspect allows for directing a spray jet of particles toward a surface having at least one of a multi-modal particle temperature distribution and a multi-modal particle velocity distribution wherein the at least one distribution is predicted to produce a dominant feature of the coating. The at least one distribution may be adjusted to produce the dominant feature of the coating.

BRIEF DESCRIPTION OF THE DRAWINGS

These and other advantages of the invention will be more apparent from the following description in view of the drawings that show.

DETAILED DESCRIPTION OF THE INVENTION

Figure 1:
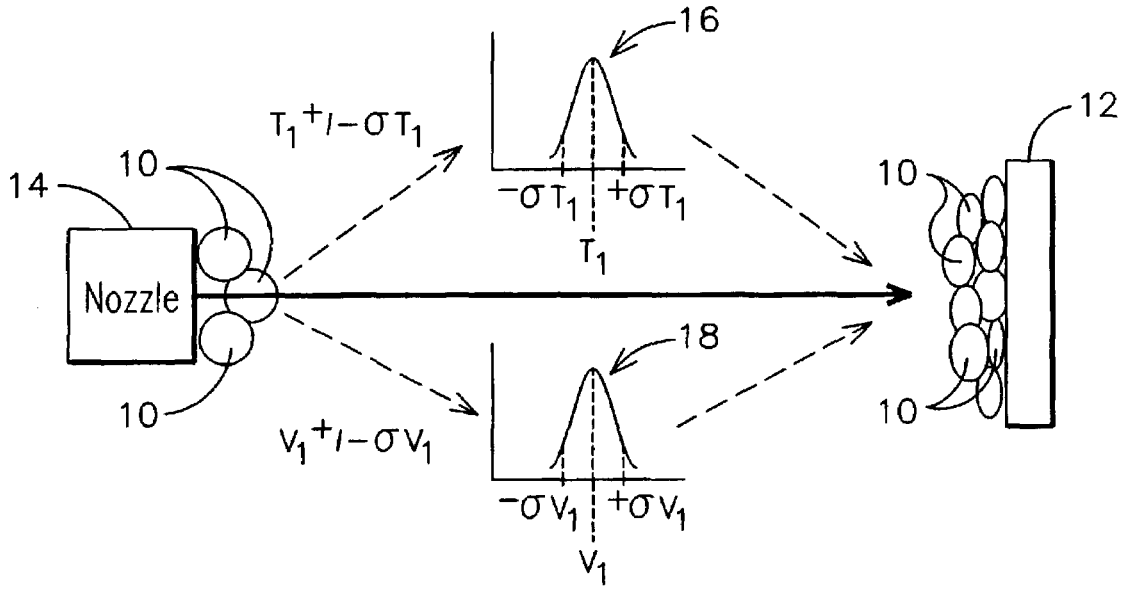
FIG. 1 PRIOR ART
FIG. 1 is a schematic of known Gaussian in-flight particle temperature and velocity distributions in an exemplary spray process.

FIG. 1 is a schematic illustration of single modal temperature and velocity distributions for in-flight particles 10 prior to impacting the surface of a substrate 12. A spray gun nozzle 14 may be used to propel a continuous stream of particles 10 toward the substrate 12 for deposition. The spray gun nozzle 14 may be a conventional nozzle such as that used in thermal or cold spray processes. It will be recognized by those skilled in the art that aspects of the present invention may be used with a variety of spray processes such as high velocity oxy-fuel ("HVOF"), low pressure plasma spray ("LPPS"), air plasma spray ("APS"), vapor plasma spray ("VPS") and cold spray, for example. Known thermal spray processes may propel particles 10 toward substrate 12 within a spray jet having Gaussian or normal distributions for temperature 16 and velocity 18. Using Gaussian distributions in this manner results in a single output of temperature and velocity from nozzle 14 with a defined standard deviation for a given set of spray process operating parameters. These parameters may be set as a function of coating specifications. The operating parameters of an HVOF process may include, for example, hydrogen values of 65 psi+/−20 psi when oxygen is scaled in a 2:1 ratio and fixed coating variables such as feed rate and barrel length of a spray gun. This type of deposition process only allows for a small window of coating microstructure and morphology to be obtained.

Figure 2:
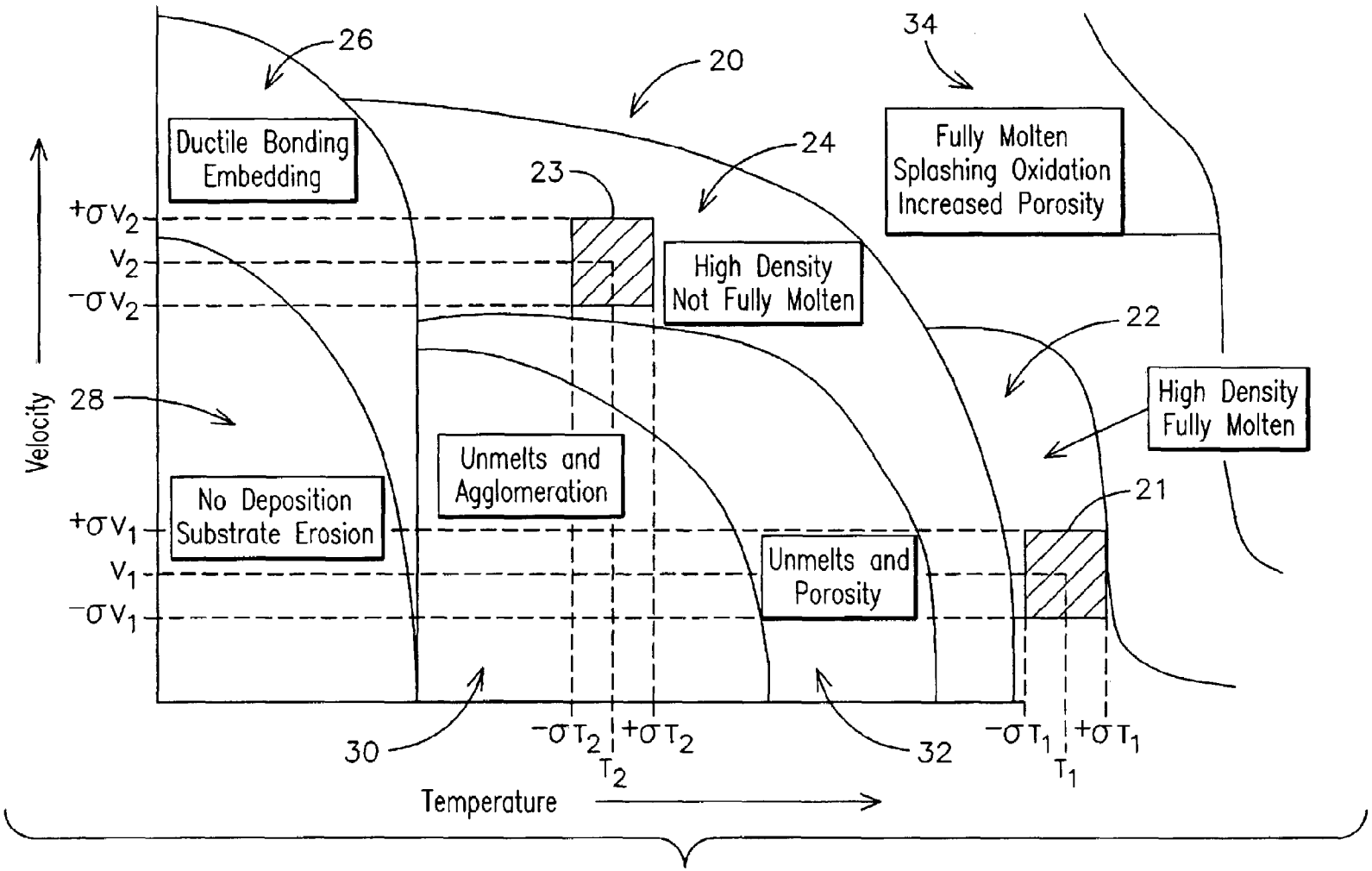
FIG. 2 PRIOR ART
FIG. 2 is a schematic velocity-temperature map illustrating exemplary coating microstructures and morphologies resulting from Gaussian in-flight particle temperature and velocity distributions.

FIG. 2 is a schematic velocity-temperature map 20 illustrating exemplary microstructures and morphologies resulting from in-flight Gaussian particle distributions for temperature and velocity. As can be seen on map 20, a spray process propelling particles with a Gaussian particle distribution of $V_1$ and a Gaussian particle distribution of $T_1$ yields a coating in an area 21 of region 22 having dominant microstructure and morphology features of high density and fully molten particles. Similarly, a spray process propelling particles with a Gaussian particle distribution of $V_2$ and a Gaussian particle distribution of $T_2$ yields a coating in an area 23 of region 24 having the dominant microstructure and morphology features of high density and not all particles fully molten. Changing the standard deviations of these velocity and temperature distributions without changing the average value of the distributions inherently affects the non-uniformity of the coatings. This is because there is a broader range of temperature and velocity over which the particles are spread during deposition prior to impact. In this respect, changing the standard deviations causes a shift of areas 21 and 23 on the map 20. FIG. 2 illustrates various other regions of the map 20 representative of the dominant microstructure and morphology features using various values for Gaussian in-flight particle distributions of temperature and velocity. For example, the dominant features of coatings in region 26 are ductile bonding and embedding of particles, in region 28 they are no deposition and substrate erosion, in region 30 they are unmelts and agglomeration, in region 32 they are unmelts and porosity and in region 34 they are fully molten particles, splashing, oxidation and increased porosity.

Any discrete deposition spray process produces a limited range of acceptable and maintainable coating structures, such as those illustrated in FIG. 2, based on the limits of the spray process operating parameters. A coating's structure may include those dominant features of the coating that may be evaluated visually and/or microscopically. Such coating structures may be defined by porosity, unmelt characteristics, interface with substrate, surface roughness, coating adherence and the coating surface profile, for example. A spray process conducted in atmosphere is limited by oxidation characteristics of the particles and interactions within an oxidizing environment. Those conducted in low pressure or vacuum are limited by the effects of splashing and agglomeration of particles within the flame. Consequently, a coating deposited with one thermal spray process may not be possible to deposit with similar structure or properties by a separate type of thermal spray process using similar deposition material or feedstock. For example, obtaining similar coating microstructure and morphology between a relatively expensive spray process, such as a Low Pressure Plasma Spray ("LPPS"), and a less expensive one, such as a High Velocity Oxygen Fuel ("HVOF"), has been intrinsically difficult and sometimes impossible using standard Gaussian distributions of in-flight particle temperature and velocity. This is because the fundamental operating ranges of in-flight particle temperature and velocity are very different between these two spray processes. Area 21 of map 20 represents the dominant microstructure and morphology features of a coating using a typical LPPS process and area 23 represents those using a typical HVOF process.

Figure 3:
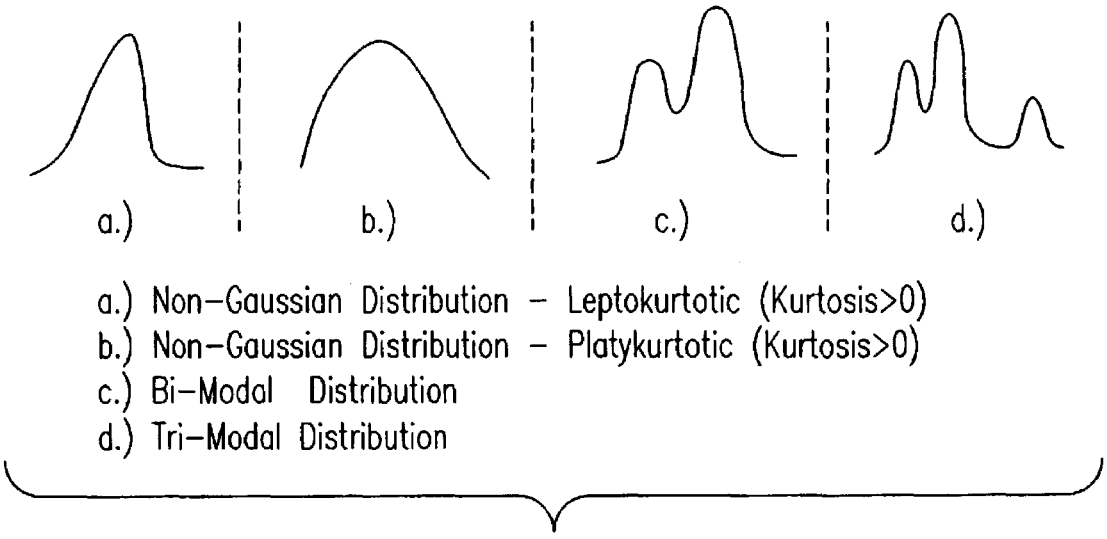
FIG. 3 illustrates exemplary non-Gaussian distributions of particle temperature and/or velocity that may be used in accordance with aspects of the present invention.

One aspect of the present invention allows for applying a coating to a substrate or surface using non-Gaussian and/or multi-modal in-flight particle temperature and/or velocity distributions. Using known Gaussian in-flight particle distributions for temperature and velocity will produce coatings having predictable dominant features with respect to their microstructure and morphology as illustrated in FIG. 2. The inventor of the present invention has determined that shifting or combining these known Gaussian distributions allows for varying or controlling the microstructure and morphology of coatings. For example, known single modal Gaussian distributions may be shifted to non-Gaussian distributions and/or single modal Gaussian distributions may be combined to be multi-modal types of distributions. Varying or controlling the microstructure and morphology of a resultant coating by shifting Gaussian distributions may be based on or a function of the dominant features, illustrated in FIG. 2, that would have been obtained independently by the component distribution or distributions being shifted to apply the resultant coating. FIG. 3 illustrates exemplary types of non-Gaussian in-flight particle temperature and/or velocity distributions that may be used to apply resultant coatings in accordance with aspects of the present invention. Non-Gaussian distribution refers to any type of in-flight particle distribution other than a single modal Gaussian or normal distribution.

The inventor of the present invention has determined through experimentation that using non-Gaussian in-flight particle temperature and/or velocity distributions causes a synergistic reaction among particles on deposition. In this respect, the synergistic reaction among particles of different temperature and velocity results in dominant features associated with each non-Gaussian distribution within a spray jet being produced in a process specific coating. Such a coating has unique microstructure and morphology features for that specific spray process. With respect to a spray jet producing a bimodal distribution of temperature and/or velocity, for example, the synergistic reaction results in a spray process that produces a coating having the same or substantially the same dominant features that would have been obtained using the combined single modal Gaussian distributions independently.

Figure 4:
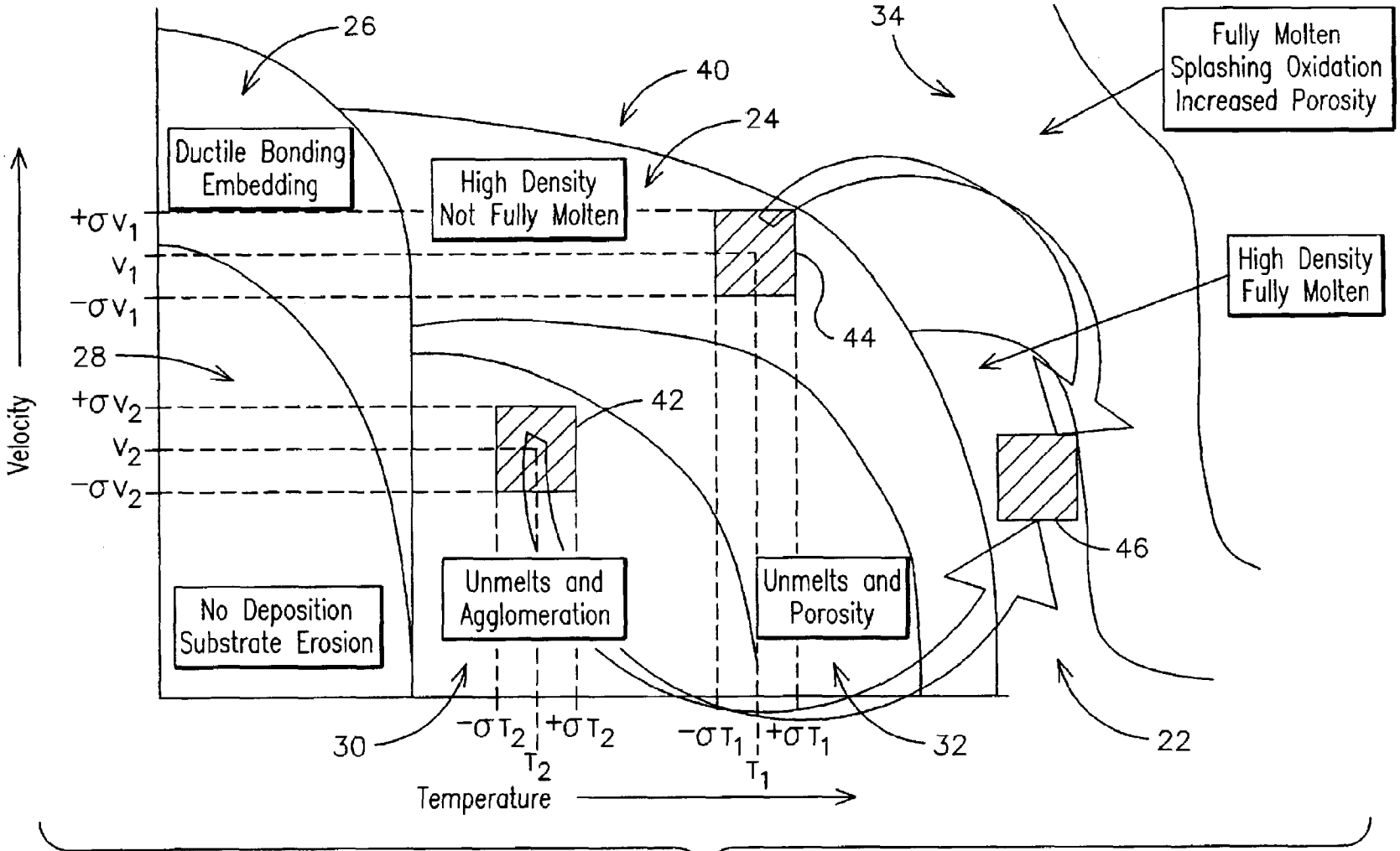
FIG. 4 is a schematic velocity-temperature map illustrating exemplary microstructures and morphologies of a resultant coating applied in accordance with aspects of the present invention.

FIG. 4 is a schematic velocity-temperature map 40 illustrating exemplary dominant microstructure and morphology features of a resultant coating applied to a substrate in accordance with aspects of the present invention. The inventor has determined through experimentation that tailoring or adjusting the in-flight Gaussian temperature and velocity distributions of MCrAlY particles in an HVOF spray process allows for applying a resultant coating having a unique microstructure and morphology. In this respect, tailoring these in-flight distributions to create an in-flight bimodal distribution produces a resultant coating having desirable dominant features. These dominant features may be substantially similar or identical to those dominant features that would have been obtained with each separate Gaussian distribution if used independently to apply a coating. A typical HVOF particle distribution has a relatively high velocity profile of approximately 625 m/s+/−100 m/s and a relatively low temperature profile of approximately 1350° C.+/−50° C. This places an HVOF deposited coating in the microstructure and morphological area 23 of the velocity-temperature map 20 of FIG. 2. A typical LPPS spray process has a relatively lower Gaussian in-flight particle velocity profile and a relatively higher Gaussian in-flight particle temperature profile than an HVOF spray process. An LPPS spray process results in a deposited coating in the microstructure and morphological area 21 of the velocity-temperature map 20.

The inventor has determined that using the Gaussian in-flight temperature and velocity profiles of MCrAlY particles of an HVOF spray process of approximately 1300° C.+/−70° C. and 700 m/s+/−70 m/s, respectively, in order to achieve a coating with high density, does not allow for producing a coating having the surface conditions of an LPPS applied coating. Reproducing a coating having LPPS microstructure and morphology with an HVOF spray process is desirable because an HVOF spray process is typically much less expensive to operate. A typical LPPS applied coating has the dominant microstructure and morphology features of a high through thickness density and high surface roughness (>300 u-in Ra). Changing the operating parameters of an HVOF spray process, such as decreasing the temperature and velocity of in-flight particles by reducing hydrogen and oxygen flow, and increasing the barrel length of the spray gun, allows for increasing the surface roughness of an HVOF coating to match that of an LPPS spray process. However, the same through thickness density is not obtained. The changes to these operating parameters result in HVOF Gaussian in-flight temperature and velocity particle distributions of approximately 1200° C.+/−150° C. and 530 m/s+/−100 m/s, respectively. These particle distributions yield a coating having the desired surface roughness but also one having massive porosity and unmelts as represented in area 42 of the velocity-temperature map 40 in FIG. 4. A coating with these dominant features is unacceptable as a bond coat, for example, based on its high temperature oxidation properties. Similarly, the inventor has determined that adjusting other operating parameters of the HVOF process will produce a coating that matches an LPPS applied coating of through thickness density but does not have the desired surface roughness.

As more fully discussed below with reference to FIGS. 5A, 5B and 5C, the inventor has determined that tailoring or adjusting the in-flight temperature and velocity distributions of the HVOF process to include both of those single modal distributions that would have independently yielded coatings in areas 42 and 44 of map 40 results in a coating having a unique microstructure with the desired surface roughness and through thickness density. This unique microstructure, represented in area 46 of FIG. 4, has the desirable dominant features from areas 42 and 44 without inclusion of the poor properties from those areas. In this respect, a resultant coating having dominant features represented by area 46 is not on the same velocity-temperature map as are areas 42 and 44. This is because area 46 represents a sum of the dominant microstructure and morphologic features represented by areas 42 and 44 and not a true sum of all features, which would include the poor, undesirable features.

Figure 5A:
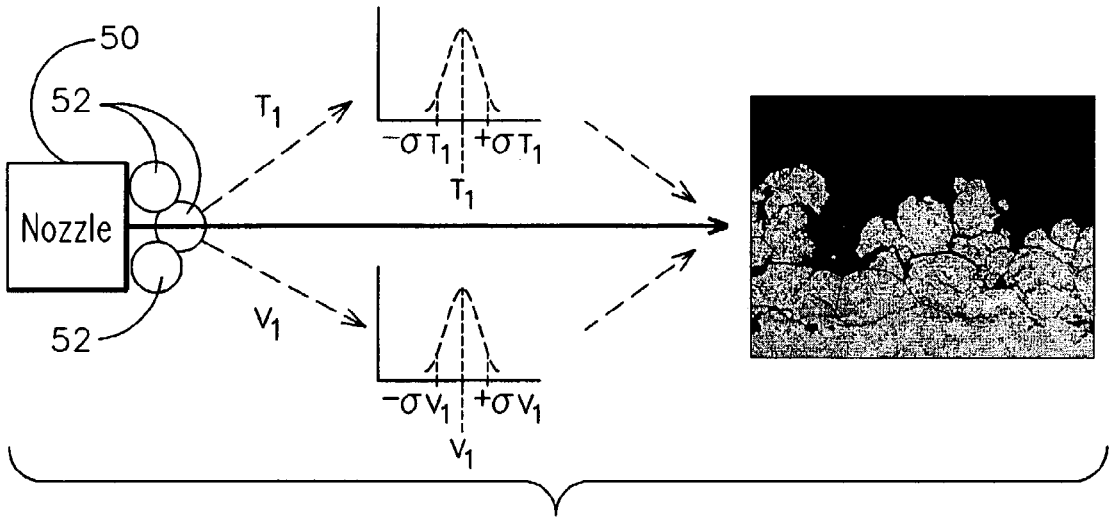
FIG. 5 is a schematic of an exemplary bimodal temperature and velocity distribution and resultant coating microstructure applied in accordance with aspects of the present invention.
Figure 5B:
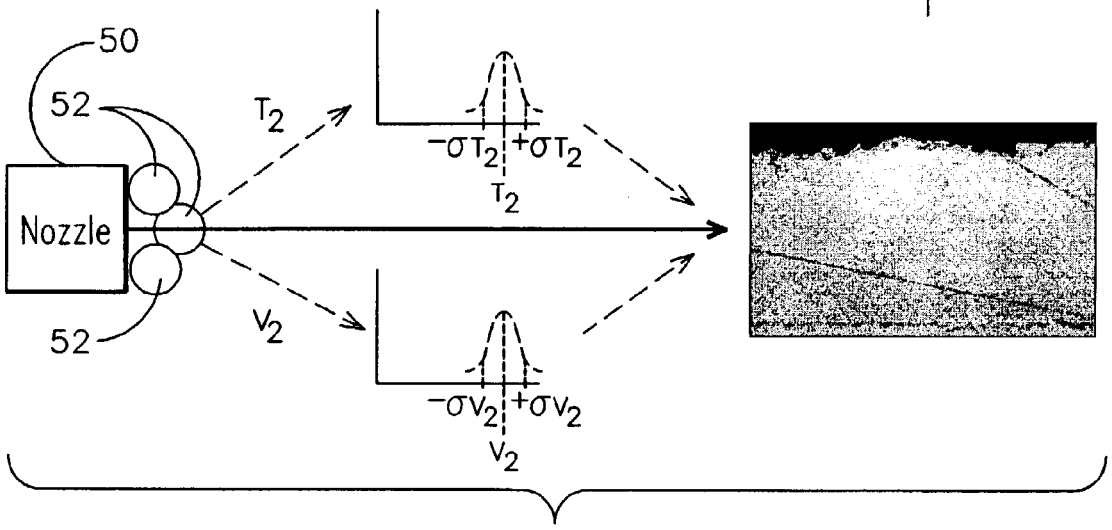
Figure 5C:
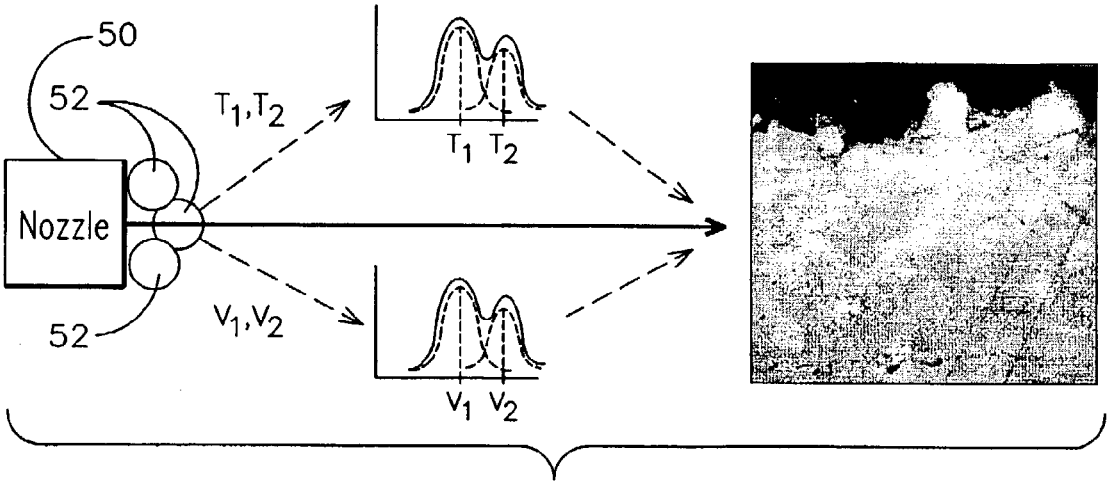

FIGS. 5A, 5B and 5C schematically illustrate an HVOF spray nozzle 50 used to propel a stream of particles 52 toward a substrate (not shown) in accordance with the experimentation conducted by the inventor and illustrated in FIG. 4. These figures also illustrate the respective micrographic analyses of the respective resultant coatings represented in areas 42 and 44 of map 40 and the dominant feature sum represented by area 46 of FIG. 4. FIG. 5A illustrates a first set of Gaussian in-flight temperature and velocity distributions, $T_1$ and $V_1$, of MCrAlY particles deposited on a substrate using an HVOF spray process. These distributions yield a coating having dominant microstructure and morphology features in area 42 of map 40. FIG. 5A also illustrates micrographically the coating obtained in this area. FIG. 5B illustrates a second set of Gaussian in-flight temperature and velocity distributions. $T_2$ and $V_2$, of MCrAlY particles deposited on a substrate using the same HVOF spray process. These distributions yield a coating having dominant micrographic and morphology features in area 44 of map 40. FIG. 5B also illustrates micrographically the coating obtained in this area. In accordance with aspects of the present invention, FIG. 5C illustrates bimodal in-flight temperature and velocity distributions, $T_1$, $T_2$ and $V_1$, $V_2$ that yield a unique resultant coating, illustrated micrographically, having the dominant micrographic and morphology features of high density and fully molten particles. This unique resultant coating is the dominant feature sum of the coatings produced by the first and second sets of Gaussian in-flight particle distributions. One aspect of the present invention allows for maintaining the same values for $T_1$, $T_2$ and $V_1$, $V_2$ in the bimodal distribution that were used in the single modal distributions of FIGS. 5A and 5B. These values may then be adjusted to shift the respective temperature and/or velocity distributions relative to each other in accordance with aspects of the present invention. For example, adjusting $T_1$ and/or $T_2$ of the bimodal temperature distribution in FIG. 5C allows for their respective peaks to shift relative to each other.

One aspect of the present invention allows for tailoring or controlling the in-flight distributions by adjusting one or more of the spray process operating parameters, such as those of a thermal spray process, for example. Typical operating parameters of a thermal spray process may include, among others that will be recognized by those skilled in the art, the carrier gas velocity, the feed rate of feedstock, particle size, the port diameter, the angular location of the feedstock port with respect to the spray jet, the angle of feedstock injection in relation to the Z axis of a spray jet, axial injection, powder injection downstream or upstream, multiple injection sites, annular injection, concentric injection, spray gun barrel length, stand off distance or other operating parameters associated with the design of feedstock introduction. Additionally, the heat source settings may determine the maximum, mean and distribution of particle temperature. The flow rates of combustion or plasma gases and the geometry of a spray torch exit nozzle may determine the maximum, mean and distribution of particle velocity. One aspect of the present invention allows for focusing two spray guns on a target substrate, and/or using two separate feedstock ports and a split flame, for example, to produce a spray jet of particles having a bimodal in-flight particle temperature distribution. Another aspect allows for using variant particle sizes in the spray process to produce a spray jet having a non-Gaussian particle temperature and/or velocity distribution.

Figure 6:
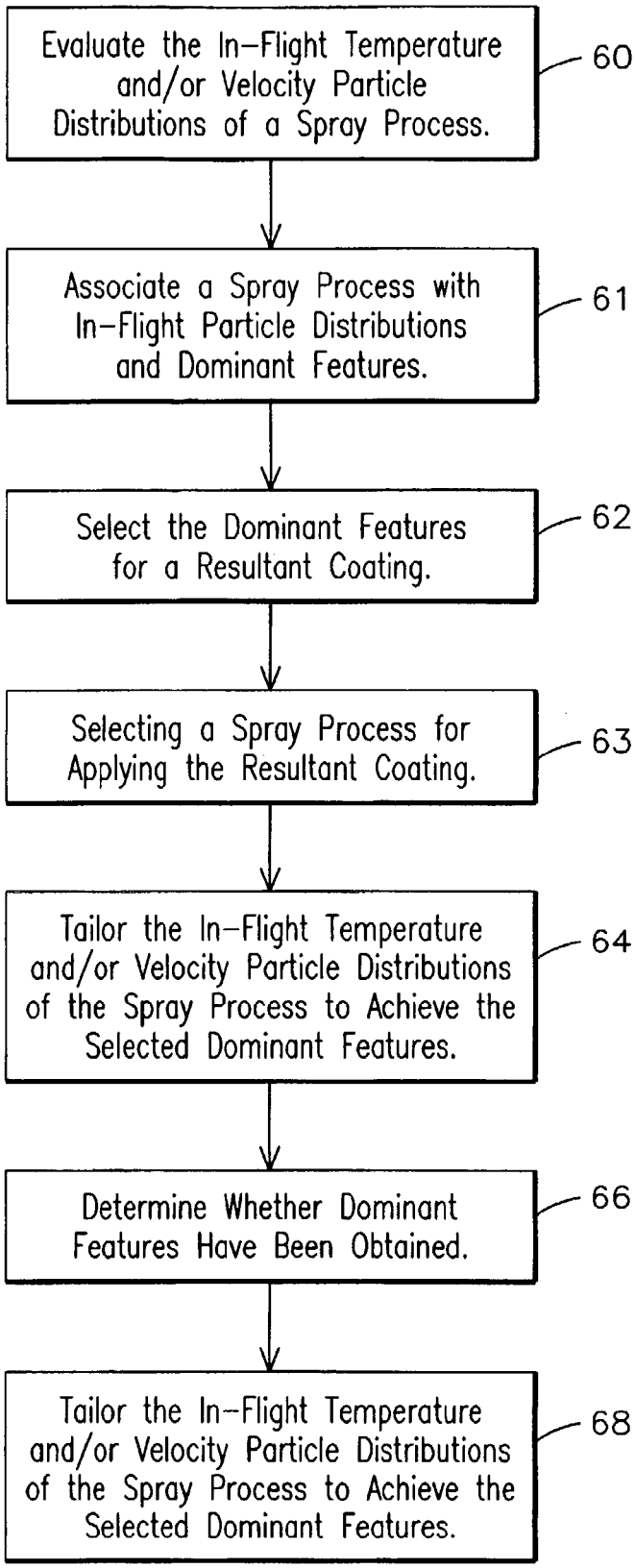
FIG. 6 is a flow diagram of an exemplary method for applying a resultant coating in accordance with aspects of the present invention.

FIG. 6 is a flow diagram of an exemplary method for applying a resultant coating in accordance with aspects of the present invention. Step 60 allows for evaluating the in-flight temperature and/or velocity particle distributions of a spray process or processes to determine the respective dominant features of a resultant coating applied with each respective distribution. The evaluated distributions may be normal or Gaussian and/or non-Gaussian distributions such as those illustrated in FIG. 3, for example. Step 61 allows for associating a set of spray process operating parameters with the in-flight particle distributions produced by that process. This step also allows for the spray process and associated distributions to be associated with the resultant dominant features of a coating applied with the process operating parameters and distributions. Step 62 allows for identifying or selecting the dominant feature or features desired for a resultant coating when applied to a substrate surface such as a superalloy used in a turbine, for example. Step 63 allows for selecting a spray process or processes that have in-flight particle temperature and/or velocity distributions predicted for producing the selected dominant features when applying the resultant coating. The associations made in step 61 allow for selecting one or more spray processes and distributions that are most likely to produce at least a portion of the desired dominant features of the resultant coating. Selecting a spray process allows for identifying the operating parameters that were used to produce the distributions of interest. These operating parameters may be used as a spray process baseline for applying a resultant coating and subsequently adjusted in accordance with aspects of the present invention. Step 63 of selecting a spray process may include selecting more than one spray process. In this respect, more than one spray gun may be used to apply a resultant coating in accordance with aspects of the present invention. For example, a first spray gun may be used to apply particles to a substrate having a first in-flight particle distribution or distributions and a second spray gun may be used concurrently, sequentially or alternating with the first to apply particles to the substrate having a second in-flight particle distribution or distributions.

During the deposition of particles on a surface, step 64 allows for tailoring or adjusting the in-flight temperature and/or velocity particle distributions to apply a resultant coating having the desired dominant features. Step 64 may include adjusting one or more operating parameters of a respective spray deposition process to tailor or adjust the in-flight distributions. The operating parameters may be adjusted during the spray process or when the spray process is not producing a spray jet. These adjustments may be performed prior to a production-coating run. Step 66 allows for determining whether the dominant features of the resultant coating have been achieved. This may be accomplished by a micrographic and/or metallurgical inspection of the applied coating or functional materials testing, for example. If the dominant features have not been obtained within acceptable limits then step 68 allows for further tailoring or adjusting of the in-flight temperature and/or velocity particle distributions to achieve the desired dominant features of the resultant coating. These steps may be repeated until the desired dominant features of the resultant coating have been achieved. The spray process operating parameters and associated in-fight particle temperature and/or velocity distributions may then be used in a production-coating run to apply a resultant coating having known dominant features.

One aspect of the present invention allows for, in step 64, combining two or more distributions evaluated in step 60 and/or selected in step 63 within a deposition spray jet with no change initially to their distribution values. In this respect, the distributions combined will use the same distribution values during deposition that were evaluated in step 60 and/or evaluated in step 63 prior to any further adjustments, if necessary, to the in-flight distributions in step 64. For example, the distributions illustrated in FIG. 5A are combined with the distributions illustrated in FIG. 5B to produce bimodal distributions of temperature and velocity illustrated in FIG. 5C. This combination, while maintaining the same distribution values for $T_1$, $T_2$ and $V_1$, $V_2$, allows for a resultant coating to be produced with a microstructure and morphology that combines at least a portion of the dominant features that would have been produced by the respective distributions if used to apply coatings independently. It will be recognized by those skilled in the art that steps 64 and 68 allow for combining a wide range of in-flight particle distributions and adjusting them during deposition to achieve a resultant coating having desirable dominant features. For example, step 64 may use a combination of two distributions and step 68 may add a third distribution. Further tailoring or adjusting of the in-flight particle distributions may then be performed to achieve the desired dominant features of the resultant coating. Also, it will be appreciated that single modal in-flight particle temperature and/or velocity distributions, whether Gaussian or non-Gaussian, may be tailored or adjusted in accordance with aspects of the present invention to produce resultant coatings having desirable microstructure and morphology suitable for a wide range of high temperature applications.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

I claim:

1. A method of depositing a coating on a substrate using a spray process, the method comprising:

selecting a first desired dominant microstructure and morphology feature for the coating to be deposited on the substrate, the first desired dominant microstructure and morphology feature known to be produced using the spray process having a first in-flight particle temperature distribution and a first in-flight particle velocity distribution;

selecting a second desired dominant microstructure and morphology feature for the coating to be deposited on the substrate, the second desired dominant microstructure and morphology feature known to be produced using the spray process having a second in-flight particle temperature distribution different from the first in-flight particle temperature distribution and a second in-flight particle velocity distribution different from the first in-flight particle velocity distribution; and controlling the spray process so that a stream of particles directed toward the substrate has at least one in-flight particle distribution selected from the group of an in-flight particle temperature distribution and an in-flight particle velocity distribution whereby the at least one in-flight particle distribution produces at least one of the first and the second desired dominant microstructure and morphology features in the coating after being deposited on the substrate.

2. The method of claim 1 wherein the step of controlling causes the spray process to have an in-flight particle temperature distribution that produces the at least one of the first and the second desired dominant microstructure and morphology feature.

3. The method of claim 1 wherein the step of controlling causes the spray process to have an in-flight particle velocity distribution that produces the at least one of the first and the second desired dominant microstructure and morphology feature.

4. The method of claim 1 further comprising:

adjusting the at least one in-flight particle distribution to cause the distribution to shift from an in-flight Gaussian particle distribution to an in-flight non-Gaussian particle distribution.

5. The method of claim 1 further comprising:

determining whether at least one of the first and the second desired dominant microstructure and morphology features for the coating is deposited within acceptable limits; and adjusting the at least one in-flight particle distribution in the event the at least one of the first and the second desired dominant microstructure and morphology features for the coating is not deposited within acceptable limits.

6. The method of claim 1 wherein the step of controlling causes the spray process to simultaneously have a first and a second in-flight particle temperature distribution and a first and a second in-flight particle velocity distribution.

7. The method of claim 6 further comprising:

depositing on the substrate a spray jet of particles having an in-flight bimodal distribution of particle temperature and an in-flight bimodal distribution of particle velocity.

8. The method of claim 7 further comprising:

adjusting at least one of the first and the second in-flight particle temperature distributions and the first and the second in-flight particle velocity distributions.

9. The method of claim 1 further comprising;

depositing a first in-flight particle distribution on the substrate with a first spray gun; and concurrently depositing a second in-flight particle distribution on the substrate with a second spray gun.

10. The method of claim 1 further comprising:

selecting a first and a second particle temperature distribution known to produce a the first desired dominant microstructure and morphology feature of the coating when applied to the surface;

selecting a first and a second particle velocity distribution known to produce a the second desired dominant microstructure and morphology feature of the coating when applied to the surface; and producing a spray jet of at particles having the selected distributions combined to form a bimodal distribution of particle temperature and a bimodal distribution of particle velocity.

11. The method of claim 1 wherein the at least one in-flight particle distribution is a multi-modal distribution.

12. The method of claim 1 wherein the at least one in-flight particle distribution includes a non-Gaussian distribution of particle temperature.

13. The method of claim 1 wherein the at least one in-flight particle distribution includes a non-Gaussian distribution of particle velocity.

14. The method of claim 1 wherein the at least one in-flight particle distribution includes a bimodal distribution of particle temperature.

15. The method of claim 1 wherein the at least one in-flight particle distribution includes a bimodal distribution of particle velocity.

16. The method of claim 1 wherein the at least one in-flight particle distribution includes a bimodal distribution of particle temperature and a bimodal distribution of particle velocity.

* * * * *